US005447581A

United States Patent [19]

Okamura et al.

[11] Patent Number: 5,447,581

[45] Date of Patent: Sep. 5, 1995

[54] PROCESS FOR PRODUCING EXTRA HIGH TENSILE STEEL IN 1080 MPA YIELD STRENGTH CLASS HAVING EXCELLENT STRESS CORROSION CRACKING RESISTANCE

[75] Inventors: Yoshihiro Okamura; Ryota Yamaba, both of Tokai, Japan

[73] Assignee: Nippon Steel Corporation, Tokyo, Japan

[21] Appl. No.: 144,927

[22] Filed: Oct. 28, 1993

[51] Int. Cl.[6] ..... C21D 8/02

[52] U.S. Cl. ..... 148/654; 148/653

[58] Field of Search ..... 148/654, 653

[56] References Cited

U.S. PATENT DOCUMENTS

| | | | |
|---|---|---|---|
| 4,814,141 | 3/1989 | Imai et al. | 420/109 |
| 4,826,543 | 5/1989 | Yano et al. | 148/12 F |
| 4,946,516 | 8/1990 | Yano et al. | 148/12 F |

FOREIGN PATENT DOCUMENTS

| | | |
|---|---|---|
| 93117726 | 4/1994 | European Pat. Off. . |
| 2307879 | 11/1976 | France . |
| 56-9358 | 1/1981 | Japan . |
| 57-188655 | 11/1982 | Japan . |
| 64-11105 | 2/1989 | Japan . |
| 1230713 | 9/1989 | Japan . |
| 151526 | 11/1989 | Japan . |
| 2167441 | 5/1986 | United Kingdom . |

*Primary Examiner*—Deborah Yee
*Attorney, Agent, or Firm*—Kenyon & Kenyon

[57] ABSTRACT

An extra high tensile steel having an excellent stress corrosion cracking resistance and a yield strength of 1080 MPa or more is provided. A slab comprising, in terms of % by weight, 0.03 to 0.08% of C, 0.01 to 0.10% of Si, 0.05 to 0.65% of Mn, 8.0 to 11.0% of Ni, 0.5 to 1.5% of Mo, 0.2 to 1.5% of Cr, 0.02 to 0.20% of V and 0.01 to 0.08% of Al with the balance consisting of iron and unavoidable impurities is heated to a temperature between 1000° C. and 1250° C., hot-rolled in an austenite recrystallization temperature region with a reduction ratio of 30 to 70%, subsequently rolled in an austenite nonrecrystallization temperature region with a reduction ratio of 20 to 60%, subjected to roll finishing, water-cooled from a temperature of 600° C. or above, reheated to so as to have an area ratio of non-diffusion type reverse transformed austenite grains of 40 to 80% and an area ratio of diffusion type reverse transformed austenite grains of 20 to 60%, quenched and then tempered at a temperature of $A_{c1}$ point or below.

2 Claims, 5 Drawing Sheets

PROCESS FOR PRODUCING EXTRA HIGH TENSILE STEEL IN 1080 MPA YIELD STRENGTH CLASS HAVING EXCELLENT STRESS CORROSION CRACKING RESISTANCE

BACKGROUND OF THE INVENTION

1. Field of the Invention

The present invention relates to a process for producing an extra high tensile steel having a yield strength of 1080 MPa or more that has a high strength despite a low carbon content and is excellent in low temperature toughness and stress corrosion resistance in a stress corrosive environment, such as sea water and salt water.

2. Description of the Prior Art

In recent years, an ever-increasing demand for energy has led to a growing interest in ocean development, such as seabed resource development and seabed crustal and geological survey, for the purpose of ensuring a stable supply of the energy, which has activated construction of containers for deep-sea use and research ships for deep-sea use or ideas for construction of seabed petroleum production bases in relation to deep-sea development.

When various containers are used in a deep-sea environment, since a very high pressure is applied thereto, it is required for materials for these containers to have a high degree of toughness and strength from the viewpoint of structure.

In order to cope with the demand for safe, reliable, high-strength and high-toughness materials, the development of a Ni-containing low alloy steel and an improvement in the quality thereof have been effected in the art. For example, proposals have been made on many production processes, such as a process for producing a high-strength and high-toughness steel comprising Ni—Cr—Mo—V with $C+\frac{1}{8}Mo+V>0.26$ and $Cr\leqq 0.8Mo$ as disclosed in Japanese Unexamined Patent Publication (Kokai) No. 56-9358, a process for producing a Ni—Cr—Mo—V—based extra high tensile steel as disclosed in Japanese Unexamined Patent Publication (Kokai) No. 57-188655, which enables a high strength and a high toughness to be provided in a wide cooling rate range in a quenching treatment, and a process for a Ni-containing steel product, wherein very low P and very low S treatments are effected for the purpose of ensuring a high toughness. These processes are effective for increasing strength or toughness. However, in none of the steels produced by the above-described processes, stress corrosion in an environment that comes into contact with sea water or salt water contemplated in the present invention is taken into consideration, so that it is difficult to say that these steels are sufficiently safe to use.

Therefore, it is required for steel products to have satisfactory resistance to stress corrosion cracking in sea water.

Examples of extra high tensile steel products having a high reliability underwater include a Ni—Cr—Mo—V-based high-toughness and extra-high-tensile steel proposed in Japanese Examined Patent Publication (Kokoku) No. 64-11105, characterized by comprising a Ni-containing steel having lowered N and O contents and capable of satisfying a requirement of Al (%) $\times$N (%) $\times 10^4<1.5$, which high-toughness and extra-high-tensile steel has a significant effect. In this steel, however, the stress corrosion cracking resistance at the welding-heat affected zone in sea water is inferior to that in the air as compared with the base material, which requires further study regarding improvement in safety and reliability. On the other hand, Japanese Examined Patent Publication (Kokoku) No. 1-51526 proposes a process for producing an extra high tensile steel having an excellent stress corrosion cracking resistance, which comprises subjecting a Ni—Mo—Nb-based steel having a Ni content of 5 to 8% to direct quenching-and-tempering. The strength of the steel product, however, is lower than that contemplated in the present invention. In the production of a thick high tensile steel by the direct quenching-and-tempering process, close control is necessary from the viewpoint of the homogeneity and anisotropy of the quality in the direction of the plate thickness. Further, there is a possibility that the stability of the quality is deteriorated in the widthwise direction and longitudinal direction within the steel plate.

Thus, the conventional extra high tensile steel products have lower stress corrosion cracking resistance particularly at the welding-heat affected zone in sea water than in the air and are produced by processes that are disadvantageous in the homogeneity of the quality in the thicknesswise direction of the thick steel plate and the stability of the quality within the steel plate. That is, a further improvement in both the steel products and production processes has been desired in the art.

In order to solve these problems, the present inventors have previously filed a patent application (see Japanese Unexamined Patent Publication (Kokai) No. 1-230713) that proposes a process for producing a high-strength and high-toughness steel having an excellent stress corrosion cracking resistance. Although the stress corrosion cracking resistance has reached a high level through a lowering in the carbon content, the development of an extra high tensile steel product having a higher strength and a high toughness has been desired in the art.

SUMMARY OF THE INVENTION

An object of the present invention is to provide a high tensile steel in 1080 MPa yield strength class that has a good resistance to stress corrosion cracking in sea water or salt water, a high strength and a high toughness. The subject matter of the present invention is as follows. A process for producing an extra high tensile steel in 1080 MPa yield strength class having an excellent stress corrosion cracking resistance, comprises the steps of: heating a slab comprising, in terms of % by weight, 0.03 to 0.08% of C, 0.01 to 0.10% of Si, 0.05 to 0.65% of Mn, more than 8.0 to 11.0% of Ni, 0.5 to 1.5% of Mo, 0.2 to 1.5% of Cr, 0.02 to 0.20% of V and 0.01 to 0.08% of Al with the balance consisting of iron and unavoidable impurities or a slab comprising the above-described ingredients and further comprising at least one member selected from the group consisting of 0.2 to 1.5% of Cu, 0.005 to 0.10% of Nb and 0.005 to 0.03% of Ti as strength improving elements and 0.0005 to 0.005% of Ca as an element having a capability of regulating the form of inclusions to a temperature between 1000° C. and 1250° C., hot-rolling the slab in an austenite recrystallization temperature region with a reduction ratio of 30 to 70%, subsequently rolling the rolled plate in an austenite noncrystallization temperature region with a reduction ratio of 20 to 60%, subjecting the rolled plate to roll finishing, water-cooling the finished steel plate from a temperature of 600° C. or above, then reheating the cooled steel plate to have an area ratio of non-diffusion type reverse transformed austenite grains of 40 to 80% and an area ratio of diffusion type reverse transformed austenite grains of 20 to 60%, quenching the reheated steel plate and then tempering the quenched steel plate at a temperature of $A_{c1}$ point or below.

DESCRIPTION OF THE PREFERRED EMBODIMENTS

Figure 1:
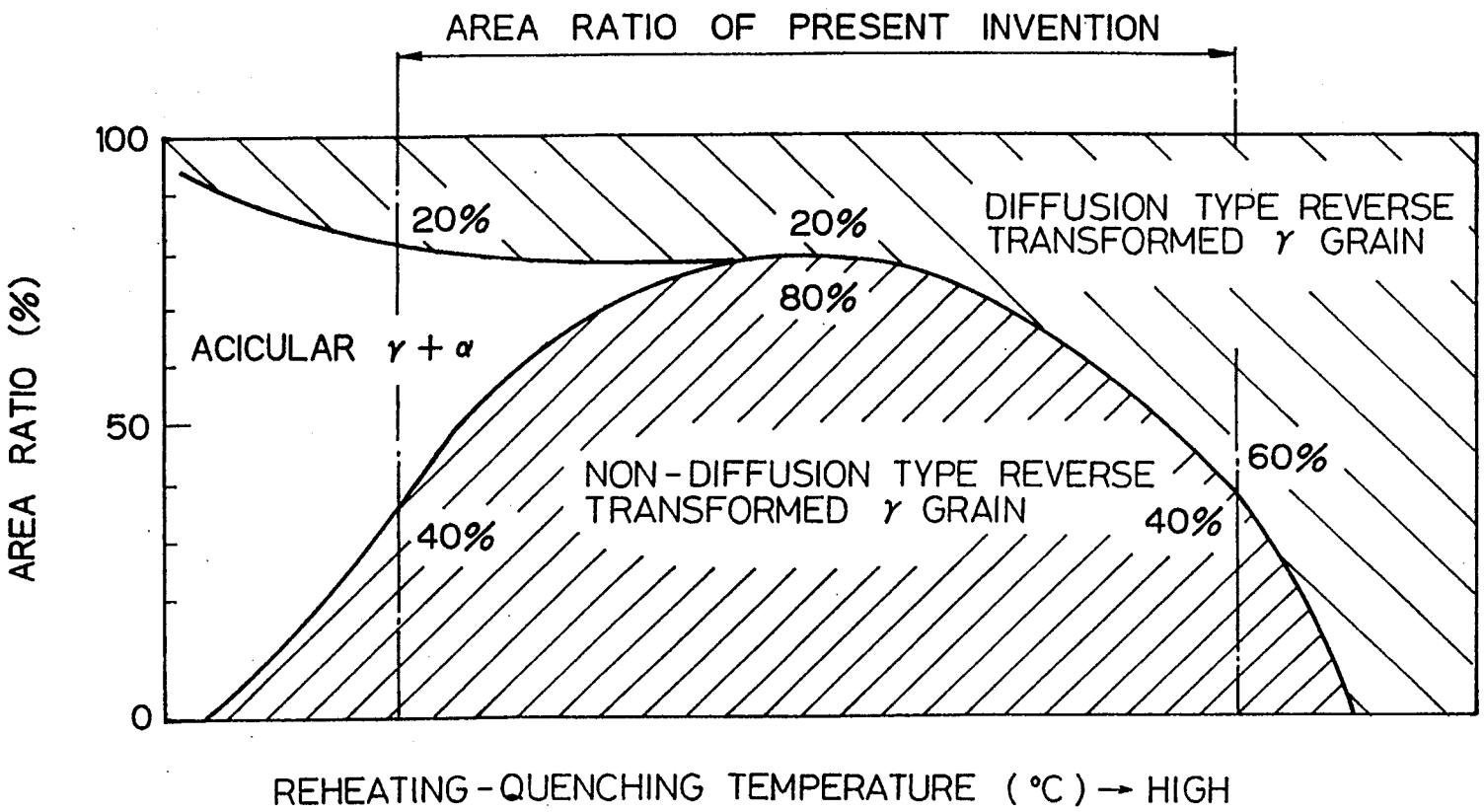
FIG. 1 is a diagram showing a change in the area ratio of non-diffusion type reverse transformed $\gamma$ grains and the area ratio of diffusion type reverse transformed $\gamma$ grains with an increase in the reheating temperature.

The present inventors have conducted various studies on steel ingredients and production process with a view to developing a Ni-containing low alloy steel having a good resistance to stress corrosion cracking in sea water or salt water and a higher strength and a higher toughness and, as a result, have found that, as described above, the carbon content of the steel has a great effect on the stress corrosion cracking resistance at the welding-heat affected zone of an extra high tensile steel and there is a tendency that, when the low-carbon, Ni-containing low alloy steel is rolled in a conventional manner, reheated, quenched (850° to 950° C.) and tempered, no intended high strength can be obtained, while when it is subjected to controlled rolling with the reduction ratio in the rolling in a nonrecrystallization region being high, although a high strength and a high toughness can be attained, anisotropy develops to lower the stress corrosion cracking resistance.

For this reason, in order to attain a higher strength than that of the previously proposed steel, the present inventors have concentrated on the behavior of carbides and the course of formation of austenite grains and effected a detailed examination particularly on a series of steps of hot rolling, reheating, quenching and tempering. As a result, they have found that, when Mo, V, Cr, etc. are added to a Ni-containing steel having lowered C and Si contents and sufficiently dissolved in a solid solution form during the step of hot rolling and the structure is brought to a fine grained martensitic structure by rolling and water cooling treatment under controlled conditions and then subjected to reheating and quenching, the Mo, V, Cr and other elements dissolved in a solid solution form are precipitated during heating to form non-diffusion type reverse transformed $\gamma$ grains comprising a group of acicular austenites having a high dislocation density, which enables a reinforcing mechanism inherent in the Ni-containing steel to be exhibited to attain an increase in the strength, and that, in this case, since the rolled structure is a fine grained martensite structure, both the non-diffusion type reverse transformed $\gamma$ grains and diffusion type reverse transformed $\gamma$ grains are refined to provide a high toughness substantially without the development of anisotropy, so that it is possible to produce an intended steel.

At the outset, the reason for the limitation of ingredients of the steel according to the present invention will now be described.

C is an element useful for improving the quenchability and easily increasing the strength. On the other hand, it has the greatest effect on an improvement in the stress corrosion cracking resistance of the welding-heat affected zone of the extra high tensile steel. When the content exceeds 0.08%, a significant lowering in the stress corrosion cracking resistance of the welding-heat affected zone occurs. On the other hand, when it is lower than 0.03%, the strength is unsatisfactory. For this reason, the C content is limited to 0.03 to 0.08%.

Si is useful for improving the strength. It is also indispensable for steel making. Si is contained in an amount of 0.01% at the smallest. In the case of a Ni-containing steel, when the Si content exceeds 0.10%, the temper brittleness becomes so great that the low-temperature toughness is lowered. For this reason, the Si content is limited to 0.01 to 0.10%.

Mn is necessary for improving the quenchability and hot workability. However, when the Mn content is less than 0.05%, the improvement effect cannot be attained. On the other hand, in the case of the Ni-containing steel contemplated in the present invention, the addition of Mn increases the susceptibility to temper brittleness and deteriorates the stress corrosion cracking resistance of the welding-heat affected zone, so that the Mn content should be 0.65% or less. For this reason, the Mn content is limited to 0.05 to 0.65%.

Ni is useful for enhancing the stacking fault energy, increasing the cross slip, facilitating the occurrence of stress relaxation, increasing the impact absorption energy and improving the low-temperature toughness.

Further, Ni exhibits the best effect when it is present together with Mo, Cr, V and other elements contained in the steel of the present invention. Specifically, a grain mixture of diffusion type reverse transformed $\gamma$ grains comprising a massive austenite formed by dissolution of carbides with non-diffusion type reverse transformed $\gamma$ grains comprising a group of acicular austenites not involving the dissolution of carbides is formed at the reheating temperature in the step of reheating and quenching of the steel after controlled rolling and water cooling, and the non-diffusion type reverse transformed $\gamma$ grains have a higher dislocation density than the diffusion type reverse transformed $\gamma$ grains and very effectively contributes to an increase in the strength. Specifically, Ni serves to delay the dissolution of carbides of Mo, V, Cr and other elements, which enables the group of acicular austenites to be stably maintained up to a high temperature. For this reason, Ni should be added in an amount of 8.0% or more for the purpose of ensuring the strength by taking advantage of stabilization of the non-diffusion type reverse transformed $\gamma$ grains at a high temperature. On the other hand, when the amount of addition of Ni exceeds 11.0%, austenite is precipitated during tempering, which deteriorates the strength and toughness. For this reason, the Ni content is limited to 8.0 to 11.0%.

Mo is an element useful for the precipitation hardening by tempering and the inhibition of temper brittleness and, at the same time, important to the present invention as with Ni. Specifically, since a fine carbide composed mainly of Mo precipitated in the course of heating in the step of reheating and quenching remains as an undissolved carbide up to a high temperature, the group of acicular austenites having a high dislocation density can be maintained at a high temperature, so that Mo is necessary for ensuring the strength. However, when the Mo content is less than 0.6%, the dissolution of the Mo carbide occurs in the reheating and quenching, which causes the non-diffusion type transformed γ grains to be rapidly attacked by the diffusion type reverse transformed γ grains, so that a contemplated strength cannot be obtained. On the other hand, when the Mo content exceeds 1.5%, the effect of improving the strength is saturated, so that the amount of coarse alloy carbides is increased to lower the toughness. For this reason, the Mo content is limited to 0.5 to 1.5%.

Cr serves to improve the quenchability and is useful for ensuring the strength. The Cr content should be 0.2% at the lowest. When it exceeds 1.5%, the increase in the strength is saturated and the toughness is lowered. For this reason, the Cr content is limited to 0.2 to 1.5%.

V is useful for forming a carbonitride in the tempering that is precipitation-hardened to ensure the strength. Further, as with Mo, V is finely precipitated during heating in the reheating and quenching to increase the stability of non-diffusion type reverse transformed γ grains comprising a group of acicular austenites, which is useful for ensuring the strength. When the V content is less than 0.02%, no contemplated strength cannot be attained, while when it exceeds 0.20%, the toughness is lowered. For this reason, the V content is limited to 0.02 to 0.20%.

Al is necessary for deoxidation and, at the same time, serves to form a nitride during heating of the slab, which is useful for refining austenite grains. However, when the Al content is less than 0.01%, this effect is small. On the other hand, when it exceeds 0.08%, the amount of inclusions comprising alumina becomes so large that the toughness is inhibited. For this reason, the Al content is limited to 0.01 to 0.08%.

In the present invention, at least one member selected from (Cu, Nb, Ti) and Ca is added besides the above-described ingredients. Cu, Nb and Ti exhibit an equalizing action, that is, serve to improve the strength of the steel. Further, Nb and Ti are useful also for the refinement of austenite grains. In order to ensure a desired effect, it is necessary for the lower limits of Cu, Nb and Ti to be 0.2%, 0.005% and 0.005%, respectively. However, when the Cu, Nb and Ti contents exceed 1.5%, 0.05% and 0.03%, respectively, not only the low-temperature toughness is lowered but also the susceptibility to stress corrosion cracking is enhanced. For this reason, the Cu, Nb and Ti contents are limited to the above-described respective ranges.

Ca is very useful for spheroidizing nonmetallic inclusions and has the effect of improving the low-temperature toughness and reducing the anisotropy of the toughness. For this purpose, the Ca content should be 0.0005% at the lowest. However, when it exceeds 0.005%, the toughness is lowered due to an increase in the amount of inclusions. For this reason, the Ca content is limited to 0.0005 to 0.005%.

The steel of the present invention contains, besides the above-described ingredients, P, S, N, O and other elements as unavoidable impurities that are detrimental to the toughness and stress corrosion cracking resistance characteristic of the steel of the present invention and, therefore, the amount of these unavoidable impurities is as small as possible. The contents of P, S, N and O are preferably regulated to 0.005% or less, 0.003% or less, 0.0050% and 0.0030%, respectively.

The production process which is another subject matter of the present invention will now be described.

Even when the steel comprises the above-described composition, the production process should be proper for attaining the strength, toughness and stress corrosion cracking resistance contemplated in the present invention. Accordingly, in the process of the present invention, the rolling, cooling and reheating-quenching-tempering conditions were limited for the following reasons.

At the outset, a slab comprising the above-described ingredients is heated to 1000° to 1250° C. In the heating, in order to attain, besides the refinement of heated austenite grains, utilization of the strengthening by taking advantage of the above-described non-diffusion type reverse transformed γ and fine precipitation in the reheating-quenching-tempering after the hot rolling, the slab should be heated to 1000° C. or above to sufficiently dissolve Mo, Cr, V, etc., in a solid solution form. In this case, when the temperature is below 1000° C., the dissolution of these elements in a solid solution form is unsatisfactory and the alloy carbide ($M_6C$) remaining undissolved is coarsened, which makes it impossible to expect sufficient precipitation hardening in the tempering and, at the same time, is causative of a lowering in the toughness. On the other hand, when the temperature exceeds 1250° C., although alloy carbides of Mo, Cr, V, etc., are sufficiently dissolved in a solid solution form, in the Ni-containing steel contemplated in the present invention, the amount of the oxide on the surface of the slab is increased, which finally results in the occurrence of a surface flaw after the rolling. Further, heated austenite grains are coarsened, and it becomes difficult to refine the austenite grains in the subsequent rolling, which is causative of a lowering in the toughness. For these reasons, the heating temperature of the slab is limited to 1000° to 1250° C.

The heated steel is then hot-rolled in such a manner that it is rolled in an austenite recrystallization temperature region with a reduction ratio of 30 to 70% and then in austenite nonrecrystallization temperature region with a reduction ratio of 20 to 60%. This is effect as a pretreatment for the refinement of non-diffusion type reverse transformed γ grains in a grain mixture of diffusion type reverse transformed γ grains with non-diffusion type reverse transformed γ grains formed during reheating and quenching after the rolling. Specifically, since the non-diffusion type reverse transformed γ grains succeed to austenite grains formed in the hot rolling, the austenite grains should be sufficiently refined by rolling.

In this case, if the reduction ratio of rolling in the austenite recrystallization temperature region is low with the reduction ratio of rolling in the austenite nonrecrystallization temperature region being high, the refinement of the austenite grains becomes so unsatisfactory that coarse elongated austenite grains are excessively formed. Since this causes the non-diffusion type reverse transformed γ grains formed during reheating and quenching to be elongated and coarsened, the anisotropy of the toughness is increased, which gives rise to an increase in the susceptibility to the stress corrosion cracking. On the other hand, if the reduction ratio of rolling in the austenite recrystallization temperature region is high with the reduction ratio of rolling in the austenite nonrecrystallization temperature region being low, since there is a limitation on the refinement of the austenite grains, this is causative of a lowering in the toughness. That is, the austenite grains should be refined as much as possible in the rolling recrystallization, and a deformation band should be introduced into the austenite grains by nonrecrystallization rolling to further refine the grains.

For the above reason, the reduction ratio should be in the range of 30 to 70% in the recrystallization temperature region and in the range of from 20 to 60% in the nonrecrystallization temperature region, and in these respective ranges, the reduction ratio in the recrystallization temperature region should be higher than that in the nonrecrystallization temperature region.

The hot-rolled steel is cooled with water from a temperature of 600° C. or above after the completion of roll finishing. The water cooling is effected for the purpose of freezing the work strain introduced in the hot rolling to provide a single phase martensite structure including a work dislocation. When this structure is used as a precursor structure, in the subsequent reheating, a carbonitride can be preferentially precipitated, so that the non-diffusion type reverse transformed $\gamma$ grains are stably maintained. Further, fine grained diffusion type reverse transformed $\gamma$ grains are formed from old austenite grain boundaries and deformation band, and after the completion of roll finishing, the strength and toughness are higher than those attained by the air cooling. However, when the water cooling is effected from a temperature of 600° C. or below, the work strain disappears and the stability of the non-diffusion type reverse transformed $\gamma$ grains is lowered, which is causative of a lowering in the strength.

The steel after hot rolling and water cooling is then reheated to such a proper temperature that the area ratio of the non-diffusion type reverse transformed $\gamma$ grains and the area ratio of the diffusion type reverse transformed $\gamma$ grains become 40 to 80% and 20 to 60%, respectively, followed by quenching.

In the step of heat treatment, wherein reheating is effected with the fine grained martensite having a deformation band formed within austenite grains used as a precursor structure, when the steel is heated to an $\alpha$-$\gamma$ dual phase coexisting temperature region, diffusion type reverse transformed $\gamma$ grains comprising an ordinary massive austenite are formed from old austenite grain boundaries and intragranular deformation band while a group of acicular austenites are formed from the intragranular martensite. They coexist together with carbides and ferrite. Since the acicular austenite is produced by non-diffusion type (martensitic) reverse transformation, it has a large amount of dislocation that contributes to an increase in the strength. However, when the temperature region is such that the area ratio of the non-diffusion type reverse transformed $\gamma$ grains and the area ratio of the diffusion type reverse transformed $\gamma$ grains are 40% or less and 20% or less, respectively, since the area of ferrite between acicular austenites is large, the quenching of this steel provides no martensitic structure having a high dislocation density, so that an increase in the strength cannot be attained.

When the steel is treated in a high temperature region through a proper combination of rolling conditions with reheating temperature region in such a manner that the area ratio of the non-diffusion type reverse transformed $\gamma$ grains and the area ratio of the diffusion type reverse transformed $\gamma$ grains are 40 to 80% and 20 to 60%, respectively, the group of acicular austenites increase their area to form non-diffusion type reverse transformed $\gamma$ grains that are stably maintained up to a high temperature and become fine austenite grains comprising a mixture thereof with diffusion type reverse transformed $\gamma$ grains, which mixture can be quenched to form a martensitic structure into which further dislocation has been introduced, so that an increase in the strength, an increase in the toughness and stress corrosion cracking resistance can be attained.

Further, when the temperature region is such that the area ratio of the non-diffusion type reverse transformed $\gamma$ grains is 40% or less with the area ratio of the diffusion type reverse transformed $\gamma$ grains being dominant, the dissolution and aggregation coarsening of carbonitrides of Mo, V, etc., cause the non-diffusion type reverse transformed $\gamma$ grains contributing to strengthening after quenching to be converted to ordinary diffusion type reverse transformed $\gamma$ grains, which gives rise to a rapid lowering in the dislocation density and a lowering in the quench hardness. As a result, the strength is lowered, and the stress corrosion cracking resistance is somewhat lowered due to coarsening of precipitates at grain boundaries.

Figure 2A:
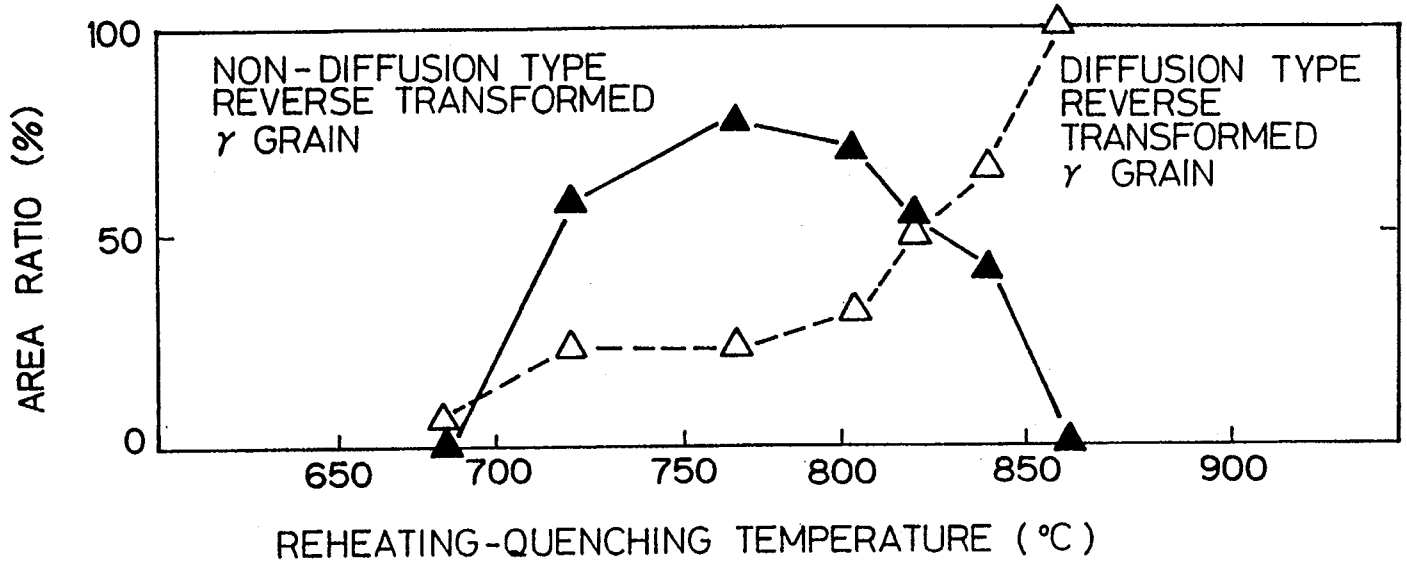
FIGS. 2(*a*), 2(*b*) and 2(*c*) are diagrams showing the relationship between the strength, stress corrosion cracking resistance (limit of $K_{ISCC}$ value) and area ratio of formed $\gamma$ grains after reheating, quenching and tempering.
Figure 2B:
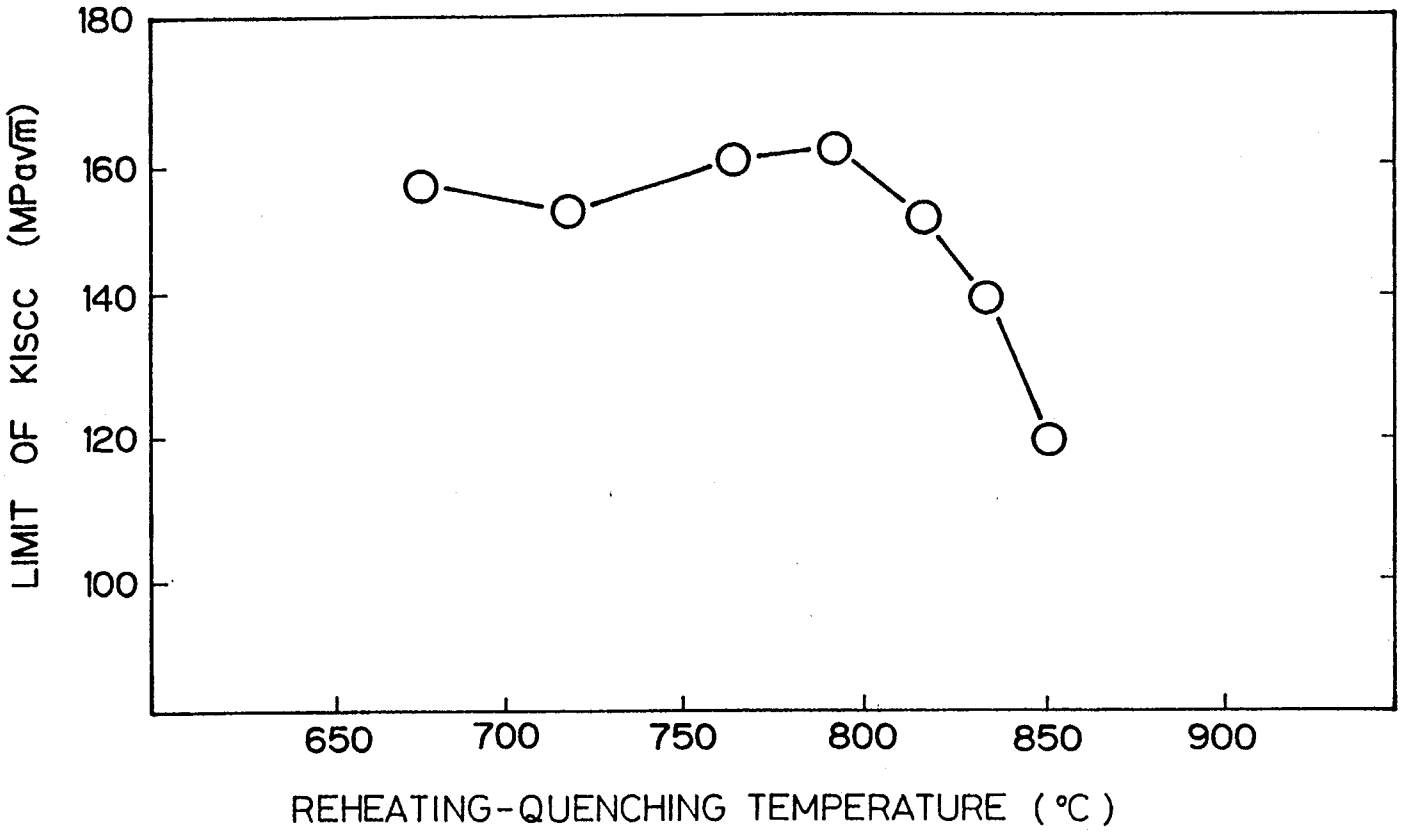
Figure 2C:
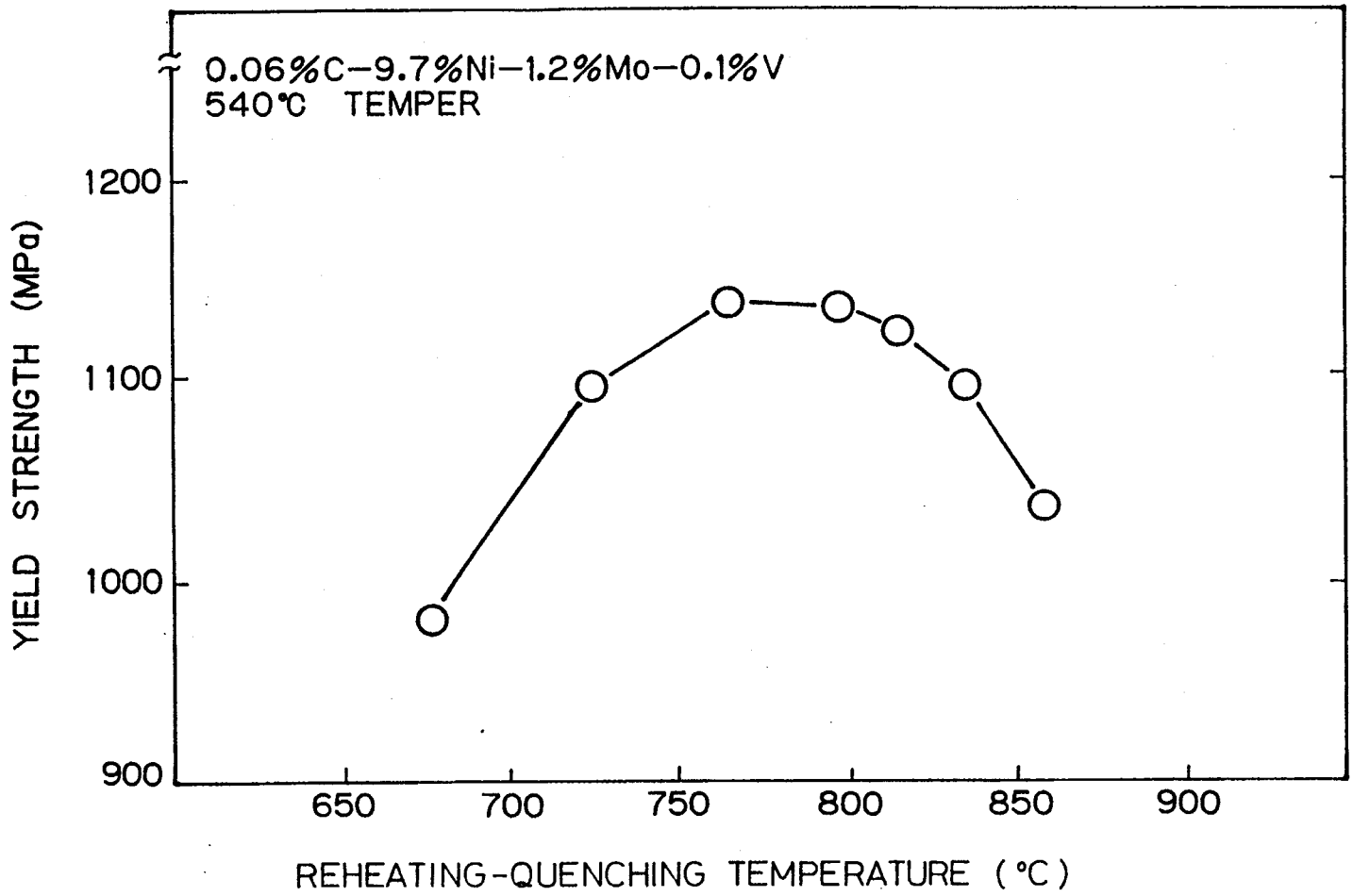

Therefore, the steel should be heated to such a temperature region that the area ratio of the non-diffusion type reverse transformed $\gamma$ grains and the area ratio of the diffusion type reverse transformed $\gamma$ grains become in the range of from 40 to 80% and in the range of from 20 to 60%, respectively, with the area ratio of the non-diffusion type reverse transformed $\gamma$ grains being higher than that of the diffusion type reverse transformed $\gamma$ grains. FIG. 1 is a diagram showing a change in the area ratio of non-diffusion type reverse transformed $\gamma$ grains and the area ratio of diffusion type reverse transformed $\gamma$ grains with an increase in the reheating-quenching temperature after controlled rolling-water cooling. With respect to FIG. 2, the steel B of the present invention (a steel comprising a composition of 0.06% C-9.7% Ni-1.2% Mo-0.1% V) listed in Table 1 was subjected to controlled rolling-water cooling and quenched with the reheating-quenching temperature being varied (the change in the area ratio of non-diffusion type reverse transformed $\gamma$ grains and the area ratio of diffusion type reverse transformed $\gamma$ grains with the reheating-quenching temperature being shown in FIG. 2 (A)) and then tempered. In this case, the strength and stress corrosion cracking resistance (limit of $K_{ISCC}$ value) after the tempering are shown in FIG. 2 (C) and FIG. 2 (B), respectively.

In the steel of the present invention, in the step of reheating and quenching, when the steel is reheated to such a temperature region that the area ratio of the non-diffusion type reverse transformed $\gamma$ grains and the area ratio of the diffusion type reverse transformed $\gamma$ grains become in the range of from 40 to 80% and in the range of from 20 to 60%, respectively, a strength increasing phenomenon occurs and the resultant steel has an intended high strength and is satisfactory also in stress corrosion cracking resistance.

The steel after reheating and quenching is then tempered at a temperature of an $Ac_1$ point or below. In this case, when the temperature exceeds the $Ac_1$ point, the strength and toughness are lowered due to the formation of unstable austenite. For this reason, the tempering temperature is limited to $Ac_1$ point or below for the purpose of sufficiently precipitation-strengthening alloy carbides of Mo, Cr, V, etc., to provide a high strength and a high toughness.

The steel provided by the above-described production process has a high strength and a high toughness despite a low carbon content and an remarkably improved stress corrosion cracking resistance.

EXAMPLES

Steels having compositions specified in Table 1 were produced by the melt process to provide slabs that were then used to produce steel plates having a thickness of 20 to 80 mm under production conditions according to the process of the present invention or comparative process specified in Table 2.

The mechanical properties of these base materials and the $K_{ISCC}$ value (limiting fracture toughness value relative to stress corrosion cracking resistance) of the base material portion and welding-heat affected zone were examined. The welding was effected at a heat input of 25 kJ/cm by TIG welding.

Figure 3:
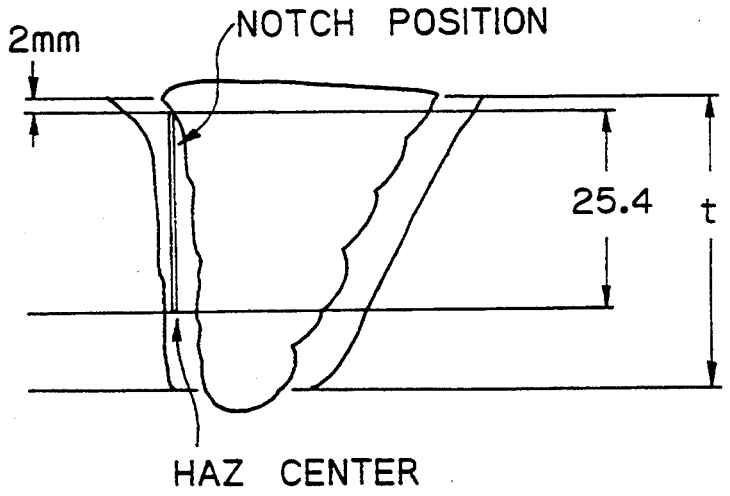
FIG. 3 is a diagram showing a notch position for the evaluation of $K_{ISCC}$ value in the welding-heat affected zone in an example of the present invention.

The mechanical properties of base materials produced by using steels having chemical compositions specified in Table 1 and production conditions specified in Table 2 and the results of $K_{ISCC}$ test for the base material portion and welding-heat affected zone using test pieces specified in ASTM E 399 in artificial sea water of 3.5% NaC1 are given in Table 3. In the evaluation method, a precracked test piece was used under a service environmental condition (in this case, sea water), and the tip of the notch is brought to a severe condition (stress load) to facilitate the occurrence of a delayed fracture. The stress corrosion cracking resistance is evaluated by effecting a constant load test under this environment at a K value (a coefficient of stress necessary for preventing the occurrence of cracking at the tip of the notch) on various levels to determine a limit of $K_{ISCC}$ value that does not cause a fracture at a certain K value or less. With respect to the evaluation of the $K_{ISCC}$ property of the welding-heat affected zone, a notch is provided at the center of HAZ as shown in FIG. 3.

In the table, the thick underlined portion is outside the scope of the present invention and unsatisfactory in the properties thereof.

TABLE 1

| | Steel | C | Si | Mn | Ni | Mo | Cr | V | Al | Cu | Nb | Ti | Ca | P | S | N | (wt. %) O |
|---|---|---|---|---|---|---|---|---|---|---|---|---|---|---|---|---|---|
| Steel of Invention | A | 0.08 | 0.05 | 0.37 | 9.21 | 0.63 | 0.85 | 0.14 | 0.028 | — | — | — | — | 0.004 | 0.001 | 0.0028 | 0.0024 |
| | B | 0.06 | 0.08 | 0.53 | 9.72 | 1.26 | 0.55 | 0.10 | 0.032 | — | — | — | — | 0.003 | 0.002 | 0.0030 | 0.0019 |
| | C | 0.04 | 0.05 | 0.50 | 10.83 | 1.02 | 1.47 | 0.12 | 0.023 | — | — | — | — | 0.004 | 0.002 | 0.0045 | 0.0028 |
| | D | 0.07 | 0.03 | 0.60 | 8.52 | 1.54 | 0.39 | 0.09 | 0.075 | — | — | — | — | 0.002 | 0.002 | 0.0018 | 0.0026 |
| | E | 0.06 | 0.08 | 0.58 | 8.20 | 1.05 | 0.76 | 0.06 | 0.036 | — | — | — | — | 0.005 | 0.001 | 0.0032 | 0.0015 |
| | F | 0.05 | 0.01 | 0.54 | 8.43 | 1.21 | 0.45 | 0.09 | 0.032 | 1.42 | — | — | — | 0.003 | 0.001 | 0.0025 | 0.0027 |
| | G | 0.06 | 0.09 | 0.40 | 9.81 | 0.95 | 0.57 | 0.06 | 0.067 | — | 0.010 | — | 0.0040 | 0.003 | 0.004 | 0.0035 | 0.0020 |
| | H | 0.03 | 0.04 | 0.51 | 9.49 | 1.28 | 0.48 | 0.03 | 0.041 | — | 0.045 | — | — | 0.002 | 0.002 | 0.0027 | 0.0018 |
| | I | 0.08 | 0.05 | 0.43 | 10.12 | 1.33 | 0.56 | 0.05 | 0.018 | — | — | 0.027 | — | 0.002 | 0.003 | 0.0040 | 0.0022 |
| | J | 0.05 | 0.04 | 0.52 | 10.91 | 1.05 | 0.27 | 0.07 | 0.031 | — | — | — | 0.0012 | 0.001 | 0.003 | 0.0042 | 0.0025 |
| | K | 0.04 | 0.07 | 0.48 | 9.46 | 0.74 | 1.16 | 0.10 | 0.025 | 0.31 | — | 0.008 | — | 0.004 | 0.002 | 0.0023 | 0.0014 |
| | L | 0.06 | 0.03 | 0.15 | 9.12 | 1.97 | 0.60 | 0.14 | 0.030 | — | — | — | — | 0.001 | 0.002 | 0.0043 | 0.0023 |
| Comp. Steel | M | 0.11 | 0.05 | 0.52 | 9.37 | 1.21 | 0.52 | 0.10 | 0.045 | — | — | — | — | 0.002 | 0.001 | 0.0028 | 0.0026 |
| | N | 0.06 | 0.07 | 0.47 | 8.24 | 0.12 | 0.95 | 0.12 | 0.026 | — | — | — | — | 0.003 | 0.002 | 0.0042 | 0.0028 |
| | O | 0.13 | 0.04 | 0.54 | 9.32 | 1.18 | 0.53 | 0.11 | 0.120 | — | — | — | — | 0.004 | 0.002 | 0.0050 | 0.0020 |
| | P | 0.07 | 0.09 | 0.60 | 4.45 | 1.20 | 0.47 | 0.09 | 0.037 | — | — | — | — | 0.003 | 0.001 | 0.0038 | 0.0023 |

TABLE 2

| | | Heating-Rolling-Direct Quenching Conditions | | | | | | | Reheating and Quenching Conditions | | | |
|---|---|---|---|---|---|---|---|---|---|---|---|---|
| | Production Condition No. | Slab Heating Temp. (°C.) | Rolling Initiation Temp. in Recrystallization Region (°C.) | Reduction Ratio in Recrystallization Region (%) | Rolling Initiation Temp. in Non-recrystallization Region (°C.) | Reduction Ratio in Non-recrystallization Region (%) | Roll Finishing Temp. (°C.) | Water Cooling Initiation Temp. (°C.) | Reheating Temp. for Quenching (°C.) | Area ratio of Non-diffusion Reverse Transformed γ grains (%) | Area ratio of Diffusion Reverse Transformed γ grains (%) | Tempering Condition Tempering Temp. (°C.) |
| Invention | 1 | 1250 | 950 | 69 | 820 | 50 | 790 | 690 | 775 | 80 | 20 | 550 |
| | 2a | 1100 | 930 | 60 | 800 | 33 | 780 | 750 | 790 | 60 | 40 | 540 |
| | 2b | 1100 | 930 | 60 | 800 | 33 | 780 | 750 | 755 | 60 | 20 | 540 |
| | 3 | 1050 | 900 | 56 | 750 | 38 | 720 | 680 | 765 | 70 | 30 | 540 |
| | 4a | 1050 | 920 | 59 | 800 | 43 | 750 | 710 | 775 | 70 | 30 | 560 |
| | 4b | 1050 | 920 | 59 | 800 | 43 | 750 | 710 | 745 | 50 | 20 | 560 |
| | 5 | 1100 | 900 | 60 | 750 | 33 | 720 | 680 | 790 | 80 | 20 | 550 |
| | 6 | 1150 | 950 | 60 | 750 | 33 | 710 | 680 | 780 | 70 | 30 | 560 |
| | 7a | 1200 | 930 | 60 | 820 | 50 | 790 | 760 | 770 | 60 | 40 | 560 |
| | 7b | 1200 | 930 | 60 | 820 | 50 | 790 | 760 | 745 | 70 | 20 | 560 |
| | 8 | 1050 | 910 | 56 | 780 | 38 | 750 | 720 | 775 | 60 | 40 | 540 |
| | 9 | 1000 | 880 | 56 | 780 | 38 | 740 | 710 | 750 | 50 | 20 | 560 |
| | 10 | 1100 | 920 | 60 | 800 | 33 | 770 | 740 | 750 | 60 | 40 | 540 |
| | 11a | 1150 | 920 | 63 | 830 | 55 | 780 | 700 | 780 | 70 | 30 | 580 |
| | 11b | 1150 | 920 | 63 | 730 | 55 | 780 | 700 | 750 | 40 | 20 | 580 |
| | 12 | 1150 | 900 | 52 | 770 | 33 | 750 | 740 | 785 | 50 | 50 | 560 |
| Comparative | 13 | 1100 | 910 | 60 | 800 | 33 | 760 | 730 | 790 | 60 | 40 | 580 |
| | 14 | 1100 | 930 | 59 | 780 | 43 | 750 | 720 | 775 | 0 | 100 | 560 |
| | 15 | 1150 | 940 | 60 | 800 | 33 | 770 | 750 | 785 | 80 | 20 | 580 |
| | 16 | 1150 | 930 | 60 | 800 | 33 | 750 | 730 | 830 | 0 | 100 | 590 |
| | 17 | 1200 | 1000 | 40 | — | — | 950 | 920 | 790 | 80 | 20 | 560 |
| | 18 | 1100 | — | — | 750 | 80 | 730 | 700 | 790 | 40 | 60 | 560 |

TABLE 2-continued

| | Heating-Rolling-Direct Quenching Conditions | | | | | | | Reheating and Quenching Conditions | | | |
|---|---|---|---|---|---|---|---|---|---|---|---|
| Production Condition No. | Slab Heating Temp. (°C.) | Rolling Initiation Temp. in Recrystallization Region (°C.) | Reduction Ratio in Recrystallization Region (%) | Rolling Initiation Temp. in Non-recrystallization Region (°C.) | Reduction Ratio in Non-recrystallization Region (%) | Roll Finishing Temp. (°C.) | Water Cooling Initiation Temp. (°C.) | Reheating Temp. for Quenching (°C.) | Area ratio of Non-diffusion Reverse Transformed γ grains (%) | Area ratio of Diffusion Reverse Transformed γ grains (%) | Tempering Condition Tempering Temp. (°C.) |
| 19 | 1100 | 930 | 60 | 800 | 33 | 770 | 740 | 840 | 0 | 100 | 540 |
| 20 | 1150 | 950 | 60 | 780 | 33 | 760 | 730 | 680 | 20 | 0 | 560 |
| 21 | 900 | 850 | 60 | 750 | 33 | 740 | 710 | 790 | 60 | 40 | 560 |
| 22 | 1050 | 920 | 59 | 800 | 43 | 770 | 740 | 850 | 0 | 100 | 560 |
| 23 | 1050 | — | — | 750 | 73 | 720 | 690 | — | — | — | 560 |

TABLE 3

| | Production Condition No. | Steel | Plate Thickness (mm) | Tensile Test Yield Strength (MPa) | Tensile Test Tensile Strength (MPa) | Tensile Test Elongation (%) | Impact Test vTrs (°C.) | Impact Test vE-70° C. (J) | Limit of $K_{1SCC}$ of Base Material (MPa √m) | Limit of $K_{1SCC}$ of Welding Heat Affected zone (MPa √m) |
|---|---|---|---|---|---|---|---|---|---|---|
| Ex. of Invention | 1 | A | 20 | 1146 | 1226 | 22 | −180 | 253 | 164 | 146 |
| | 2a | B | 40 | 1140 | 1263 | 22 | −196 | 251 | 186 | 161 |
| | 2b | B | 40 | 1126 | 1248 | 22 | −180 | 245 | 170 | 161 |
| | 3 | C | 50 | 1162 | 1287 | 23 | −170 | 246 | 167 | 158 |
| | 4a | D | 40 | 1138 | 1276 | 22 | −170 | 243 | 167 | 146 |
| | 4b | D | 40 | 1123 | 1261 | 23 | −180 | 250 | 175 | 146 |
| | 5 | E | 40 | 1128 | 1218 | 24 | −170 | 242 | 155 | 149 |
| | 6 | F | 40 | 1141 | 1280 | 23 | −170 | 240 | 174 | 164 |
| | 7a | G | 40 | 1136 | 1265 | 22 | −196 | 267 | 164 | 146 |
| | 7b | G | 40 | 1142 | 1271 | 22 | −180 | 256 | 174 | 146 |
| | 8 | H | 50 | 1125 | 1285 | 24 | −170 | 258 | 186 | 171 |
| | 9 | I | 80 | 1181 | 1282 | 22 | −160 | 235 | 161 | 146 |
| | 10 | J | 40 | 1145 | 1250 | 23 | −170 | 247 | 158 | 152 |
| | 11a | K | 20 | 1192 | 1290 | 22 | −180 | 243 | 164 | 155 |
| | 11b | K | 20 | 1164 | 1262 | 22 | −170 | 238 | 172 | 155 |
| | 12 | L | 80 | 1144 | 1277 | 23 | −170 | 239 | 161 | 152 |
| Comp. Ex. | 13 | M | 40 | 1132 | 1234 | 23 | −150 | 218 | 155 | 90 |
| | 14 | N | 40 | 983 | 1103 | 24 | −120 | 243 | 164 | 136 |
| | 15 | O | 40 | 1106 | 1218 | 20 | −70 | 76 | 96 | 62 |
| | 16 | P | 40 | 848 | 937 | 24 | −140 | 227 | 186 | 130 |
| | 17 | B | 40 | 1087 | 1182 | 22 | −100 | 152 | 158 | 161 |
| | 18 | B | 40 | 1090 | 1209 | 21 | −130 | 204 | 121 | 161 |
| | 19 | B | 40 | 1042 | 1152 | 23 | −120 | 211 | 127 | 161 |
| | 20 | B | 40 | 994 | 1125 | 22 | −100 | 160 | 164 | 161 |
| | 21 | D | 40 | 1049 | 1131 | 24 | −100 | 142 | 149 | 146 |
| | 22 | D | 40 | 1024 | 1153 | 22 | −130 | 214 | 130 | 146 |
| | 23 | D | 40 | 1102 | 1218 | 23 | −130 | 216 | 109 | 146 |

Note) A $K_{1SCC}$ test piece for the base material was sampled from ¼t portion of Plate thickness and notched in the C direction. On the other hand, a test piece for the welding-heat affected zone was notched at the center of the welding heat affected zone. These test pieces were tested in 3.5% NaCl artificial sea water.

In the examples of the present invention (1-A to 12-L wherein steels falling within the scope of the present invention is used in combination with the process of the present invention), the base materials had good mechanical properties, i.e., a high strength and a high toughness, and with respect to the stress corrosion cracking resistance as well, both the base material and welding-heat affected zone had a sufficiently high $K_{ISCC}$ value.

On the other hand, with respect to comparative examples wherein the process falling within the scope of the present invention is used in combination with comparative steels (M, N, O and P) outside the chemical composition range specified in the present invention, in 13-M, since the C content is high, the $K_{ISCC}$ value at the welding-heat affected zone is low. In 14-N, since the Mo content is low, non-diffusion type reverse transformed γ grains are not formed and the precipitation strengthening is also small, so that the strength is unsatisfactory. In 15-0, since the C content is high, the $K_{ISCC}$ value at the welding-heat affected zone is low. Further, in this case, since the Al content too is high, the amount of inclusions is increased, so that the toughness of the base material is lowered. In 16-P, since the Ni content is low, non-diffusion type reverse transformed γ grains are not formed, so that the strength is unsatisfactory.

With respect to the comparative examples wherein steels falling within the scope of the present invention are used in combination with comparative processes (17 to 23) outside the scope of the present invention, in 17-B, since rolling in the recrystallization temperature region alone is effected, the refinement of elongated austenite grains is so unsatisfactory that the grains become coarse and the toughness is unsatisfactory. In 18-B, since the reduction ratio in the rolling in the nonrecrystallization temperature region is so high that the coarse elongated austenite grains are inherited until reheating and quenching, which causes the $K_{ISCC}$ value of the base material to be somewhat lowered. In 19-B and 22-D, the reheating temperature for quenching is high, non-diffusion type reverse transformed $\gamma$ grains are not formed with diffusion type reverse transformed $\gamma$ grains alone being left, so that the strength of the base material is unsatisfactory. Further, there is a tendency that precipitates at grains boundaries are coarsened to lower the limit of $K_{ISCC}$ value of the base material. In 20-B, since the reheating temperature for quenching is low, a large amount of ferrite is mixed into between the group of acicular austenites, which makes it impossible to form non-diffusion type reverse transformed $\gamma$ grains having a high hardness, so that the strength and toughness are unsatisfactory. In 21-D, since the heating temperature of the slab is low, not only coarse undissolved precipitates of alloy carbides are present but also the precipitation strengthening is small, so that the strength and toughness are unsatisfactory. In 23-D, since the reduction ratio in the nonrecrystallization temperature region is high and the reheating and quenching are not effected, the limit of the $K_{ISCC}$ value of the base material is lowered.

As described above, the composition range and process according to the present invention have made it possible to produce an extra high tensile steel having a yield strength of 1080 MPa or more that has a high strength and a high toughness and an excellent stress corrosion cracking resistance. This has enabled satisfactory safety to be ensured under service environmental conditions.

We claim:

1. A process for producing an extra high tensile steel in 1080 MPa yield strength class having an excellent stress corrosion cracking resistance, comprises the steps of: heating a slab comprising, in terms of % by weight, 0.03 to 0.08% of C, 0.01 to 0.10% of Si, 0.05 to 0.65% of Mn, more than 8.0 to 11.0% of Ni, 0.5 to 1.5% of Mo, 0.2 to 1.5% of Cr, 0.02 to 0.20% of V and 0.01 to 0.08% of Al with the balance consisting of iron and unavoidable impurities, to a temperature between 1000° C. and 1250° C., hot-rolling the slab in an austenite recrystallization temperature region with a reduction ratio of 30 to 70%, subsequently rolling the rolled plate in an austenite nonrecrystallization temperature region with a reduction ratio of 20 to 60%, subjecting the rolled plate to roll finishing, water-cooling the finished steel plate from a temperature of 600° C. or above, then reheating the cooled steel plate to have an area ratio of non-diffusion type reverse transformed austenite grains of 40 to 80% and an area ratio of diffusion type reverse transformed austenite grains of 20 to 60%, quenching the reheated steel plate and then tempering the quenched steel plate at a temperature of $A_{c1}$ point or below.

2. A process for producing an extra high tensile steel in 1080 MPa yield strength class having excellent stress corrosion cracking resistance, comprises the steps of: heating a slab comprising, in terms of % by weight, 0.03 to 0.08% of C, 0.01 to 0.10% of Si, 0.05 to 0.65% of Mn, more than 8.0 to 11.0% of Ni, 0.5 to 1.5% of Mo, 0.2 to 1.5% of Cr, 0.02 to 0.20% of V and 0.01 to 0.08% of Al and further comprising at least one member selected from the group consisting of 0.2 to 1.5% of Cu, 0.005 to 0.10% of Nb and 0.005 to 0.03% of Ti as strength improving elements and 0.0005 to 0.005% of Ca as an element having a capability of regulating the form of inclusions with the balance consisting of iron and unavoidable impurities, to a temperature between 1000° C. and 1250° C., hot-rolling the slab in an austenite recrystallization temperature region with a reduction ratio of 30 to 70%, subsequently rolling the rolled plate in an austenite nonrecrystallization temperature region with a reduction ratio of 20 to 60%, subjecting the rolled plate to roll finishing, water-cooling the finished steel plate from a temperature of 600° C. or above, then reheating the cooled steel plate to have an area ratio of non-diffusion type reverse transformed austenite grains of 40 to 80% and an area ratio of diffusion type reverse transformed austenite grains of 20 to 60%, quenching the reheated steel plate and then tempering the quenched steel plate at a temperature of $A_{c1}$ point or below.

* * * * *